US007853181B2

(12) United States Patent
Sugimoto et al.

(10) Patent No.: US 7,853,181 B2
(45) Date of Patent: Dec. 14, 2010

(54) DEVELOPING UNIT AND IMAGE FORMING APPARATUS USING THE SAME

(75) Inventors: Tsutomu Sugimoto, Yamatokoriyama (JP); Osamu Wakuda, Yamatotakada (JP); Yuichi Kazaki, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 515 days.

(21) Appl. No.: 11/953,662

(22) Filed: Dec. 10, 2007

(65) Prior Publication Data

US 2008/0159789 A1 Jul. 3, 2008

(30) Foreign Application Priority Data

Dec. 28, 2006 (JP) ..... 2006-353816

(51) Int. Cl.
*G03G 15/08* (2006.01)

(52) U.S. Cl. ..... 399/255; 399/288

(58) Field of Classification Search ..... 399/254–256, 399/258, 262, 288
See application file for complete search history.

(56) References Cited

U.S. PATENT DOCUMENTS 5,572,299 A 11/1996 Kato et al.
2006/0275054 A1* 12/2006 Seorl ..... 399/258

FOREIGN PATENT DOCUMENTS

| | | |
|---|---|---|
| JP | 5-127537 A | 5/1993 |
| JP | 5-289497 A | 11/1993 |
| JP | 9-138579 | 5/1997 |
| JP | 2001-201930 | 7/2001 |
| JP | 2003-302837 | 10/2003 |

* cited by examiner

*Primary Examiner*—David M Gray
*Assistant Examiner*—Gregory H Curran
(74) *Attorney, Agent, or Firm*—Nixon & Vanderhye, PC

(57) ABSTRACT

A developing unit for visualizing an electrostatic latent image formed on a photoreceptor drum with a toner, includes: a hopper for storing a developer; a developing roller for supplying the toner to a photoreceptor drum on which an electrostatic latent image is formed; and an agitating and conveying portion. In the developing unit, the agitating and conveying portion includes first and second agitating and conveying belts, each having toner agitating blades for agitating and conveying the toner. The first and second agitating and conveying belts are rotatably arranged in the hopper with their rotational axes set approximately vertically so as to rotate the toner agitating blades approximately horizontally.

22 Claims, 6 Drawing Sheets

DEVELOPING UNIT AND IMAGE FORMING APPARATUS USING THE SAME

This Nonprovisional application claims priority under 35 U.S.C. §119 (a) on Patent Application No. 2006-353816 filed in Japan on 28 Dec. 2006, the entire contents of which are hereby incorporated by reference.

BACKGROUND OF THE TECHNOLOGY

1. Field of the Technology

The technology relates to a developing unit and an image forming apparatus using this. The technology, in particular, directed to a developing unit including an agitating and conveying portion for agitating and conveying a developer in the developer storing portion for storing the developer containing an electrostatically chargeable toner and a magnetic carrier to visualize an electrostatic latent image formed on a photoreceptor drum with the toner, which is constructed to agitate the developer in the developer storing portion without unevenness as well as to an image forming apparatus using this developing unit.

2. Description of the Prior Art

In a conventional image forming apparatus such as a printer etc. using the electrophotography, a printout of an image is formed by electrifying a photoreceptor drum that is driven rotationally by a charger, forming an electrostatic latent image by illuminating the photoreceptor drum with light in accordance with image information, forming a toner image by applying the toner to the electrostatic latent image by a developing unit and transferring the toner image to a sheet material or other recording media.

As the developer used for the developing unit of the image forming apparatus, use has been made of, for example a dual-component developer which is prepared by mixing two components, or an electrostatically chargeable toner and a magnetic carrier.

In the thus constructed image forming apparatus, the developer is stored in the developer storing portion as a part of the developing unit and is agitated inside the developer storing portion and conveyed to the developing roller by an agitating and conveying means.

Conventionally, the means for agitating and conveying the developer in the above way has been usually realized with conveyor belts, conveying screws, paddles and the like.

As an example using a conveyor belt, there has been proposed a configuration for agitating and conveying the toner in the toner supply container, in which an circulating endless conveyor belt having conveying projections on its outer surface and agitating projections on its inner surface is arranged to agitate and convey the toner inside the toner supply container (see Patent document 1: Japanese Patent Application Laid-open Hei 9-138579).

Also three has been proposed a configuration for agitating and conveying the developer in the developing unit, in which a magnetic belt is adopted as a conveyor belt so that the magnetic belt carrying the developer on its surface by magnetic force is moved to convey the developer toward the developing roller while agitating the developer therearound (see Patent document 2: Japanese Patent Application Laid-open 2003-302837).

Further, there has been proposed another configuration, in which a screw is used to send back the collected toner into the developing unit while inside the developing unit the collected toner is conveyed by a conveyor belt (see Patent document 3: Japanese Patent Application Laid-open 2001-201930).

However, since in any of the above conventional technologies, the developer containing toner is agitated and conveyed by moving the belt surface or agitating and conveying projections of the conveying belt upwards or downwards, the agitating effect in the vertical direction is weak. Further, there is a problem that when the developer is conveyed toward the developing roller, the developer is unlikely to be agitated and dispersed uniformly with respect to the axial direction of the developing roller or across the main scan direction.

SUMMARY OF THE TECHNOLOGY

The technology has been devised in view of the above problems, it is therefore an object to provide a developing unit as well as an image forming apparatus which, with a simple structure, enables uniform and prompt agitation and dispersion of the developer by reducing the agitation unevenness of the developer inside the developing unit to thereby realize toner images improved in image quality.

In order to achieve the above object, the developing unit and image forming apparatus using the developing unit are configured as follows.

A developing unit according to the first aspect is a developing unit for visualizing an electrostatic latent image formed on an electrostatic latent image bearer with a toner, comprising: a developer storing portion for storing a developer containing an electrostatically chargeable toner and a magnetic carrier; a developing roller for supplying the toner to an electrostatic latent image bearer on which an electrostatic latent image is formed; and an agitating and conveying portion for agitating and conveying the developer in the developer storing portion, and is characterized in that the agitating and conveying portion includes a toner agitating and conveying member having toner agitating blades for agitating and conveying the toner, and the toner agitating and conveying member is rotatably arranged in the developer storage portion with its rotational axis oriented approximately vertically so as to rotate the toner agitating blades approximately horizontally.

A developing unit according to the second aspect is characterized in that, in addition to the above first configuration, a toner supply device for supplying toner when the toner concentration in the developer inside the developer storing portion has lowered is arranged at the top of the developer storing portion, and the toner agitating and conveying member is arranged under the toner supply device and agitates and conveys the toner supplied from the toner supply device.

A developing unit according to the third aspect is characterized in that, in addition to the above first or second configuration, the toner agitating and conveying member is an endless belt element having the toner agitating blades on the outer periphery thereof.

Also, instead of the belt element, a rotator having toner agitating blades formed on the outer periphery may be used. Further, it is also possible to arrange a plurality of such rotators parallel.

A developing unit according to the fourth aspect is characterized in that, in addition to the above third configuration, as the belt element configuration, the belt element is backed by a reinforce, e.g., glass fiber close, along the belt base to which the belt agitating blades provided.

A developing unit according to the fifth aspect is characterized in that, in addition to any one of the above first to fourth configurations, the toner agitating blades are provided approximately perpendicularly relative to the circulating direction of the toner agitating and conveying member.

That is, the toner agitating blades are arranged approximately vertically and perpendicularly to the toner agitating and conveying member.

A developing unit according to the sixth aspect is characterized in that, in addition to any one of the above first to fourth configurations, the toner agitating blades are provided inclined with respect to the circulating direction of the toner agitating and conveying member.

That is, the toner agitating blades are arranged approximately inclined with respect to perpendicular direction of the toner agitating and conveying member.

A developing unit according to the seventh aspect is characterized in that, in addition to sixth configuration, as the toner agitating blade configuration, in each of the toner agitating blades a plurality of cutouts are formed along the width direction of the belt element, from the top of the toner agitating blade to the base of the toner agitating and conveying member where the toner agitating blade is attached.

A developing unit according to the eighth aspect is characterized in that, in addition to any one of the above third to seventh configurations, the agitating and conveying portion includes: as the rotary shafts for rotating the belt element, first and second rotary shafts provided inside the developer storing portion and arranged apart from each other in the axial direction of the developing roller; and first and second pulleys which are axially supported by the first and second rotary shafts respectively, the belt element is wound between first and second pulleys and supported along the axial direction of the developing roller, and a toner conveying path through which the toner is conveyed is formed along and around the belt element in the developer storing portion, the toner on the near side of the developing roller and the toner on the far side thereof with the belt element being conveyed in opposite directions to each other.

A developing unit according to the ninth aspect is characterized in that, in addition to the above eighth configuration, a partitioning wall that extends in the axial direction of the developing roller is arranged in the inside area enclosed by the belt element and between the first and second pulleys where the two parts of the belt element oppose each other.

A developing unit according to the tenth aspect is characterized in that, in addition to the above eighth or ninth configuration, first and second belt elements as the belt elements are arranged in series in the axial direction of the developing roller, first and second toner conveying paths as the toner conveying paths are formed corresponding to the first and second belt elements, respectively, and the first belt element and the second belt element are driven to rotate so that the developer in the first toner conveying path and the developer in the second toner conveying path on their developing roller side, are both conveyed toward the approximate center of the developing roller with respect to the axial direction.

A developing unit according to the eleventh aspect is characterized in that, in addition to any one of the above eighth to tenth configurations, at least one rotary shaft of the first and second rotary shafts is arranged so as to be shiftable in the axial direction of the developing roller.

A developing unit according to the twelfth aspect is characterized in that, in addition to the above eleventh configuration, at least one rotary shaft of the first and second rotary shafts is urged in a direction that gives tension to the belt element.

An image forming apparatus unit according to the thirteenth aspect includes: a developing unit for visualizing an electrostatic latent image formed on an electrostatic latent image bearer with a toner, comprising: a developer storing portion for storing a developer containing an electrostatically chargeable toner and a magnetic carrier; a developing roller for supplying the toner to the electrostatic latent image bearer; and an agitating and conveying portion for agitating and conveying the developer in the developer storing portion, whereby printout of an image is formed by transferring a developer image formed by electrophotography on the surface of the electrostatic latent image bearer, to a transfer medium, and is characterized in that one of the developing units described in the above first to twelfth aspects is used.

According to the technology described in the first aspect, the developer containing toner is not conveyed whilst just being placed on the surface of the toner agitating and conveying member, but can be conveyed whilst efficiently agitated by the toner agitating blades in the vertical direction and in the circulating direction of the toner agitating blades. Accordingly, it is possible to reduce agitation unevenness of the developer and perform prompt agitation and dispersion of the developer. This enables optimal toner supply to the developing roller, it is hence possible to realize toner images improved in image quality.

According to the technology described in the second aspect, in addition to the effect obtained by the first aspect, it is possible to efficiently agitate the toner supplied from the toner supply device with the existing developer in the developer storing portion.

According to the technology described in the third aspect, in addition to the effect obtained by the first or second aspect, it is possible with a simple configuration to continuously and efficiently agitate and convey the toner. Further, if a plurality of rotators which have toner agitating blades on the outer periphery thereof and are arranged parallel to each other in a row are used instead of the belt member, it is possible to continuously and efficiently agitate and convey the toner similarly to the above.

According to the technology described in the fourth aspect, in addition to the effect obtained by the third aspect, it is possible to realize a belt element having a long life with enhanced strength.

According to the technology described in the fifth aspect, in addition to the effect obtained by any one of the first to fourth aspects, it is possible to efficiently and uniformly agitate and convey the toner.

According to the technology described in the sixth aspect, in addition to the effect obtained by the fifth aspect, it is possible to change the function and behavior of agitating the developer in the vertical direction in accordance with the angle of inclination of the toner agitating blades. That is, it is possible to arrange the toner agitating blades so that the adjacent ones have opposite inclinations from each other.

According to the technology described in the seventh aspect, in addition to the effect obtained by the sixth aspect, it is possible to eliminate generation of unnecessary stress arising with deformation of the toner agitating blades of the belt element when belt member passes over the pulleys, it is hence possible to inhibit degradation of the performance of the belt member. That is, it is possible to extend the belt member's lifetime.

According to the technology described in the eighth aspect, in addition to the effect obtained by any one of the third to seventh aspects, it is possible to agitate and convey the developer efficiently by circulating the developer from the path on the developer roller side to the path on the opposite side from the developer roller.

According to the technology described in the ninth aspect, in addition to the effect obtained by the eighth aspect, it is possible to agitate and convey the developer without making the developer get mixed between the developer roller's side and the opposite side from the developer roller across the belt member.

According to the technology described in the tenth aspect, in addition to the effect obtained by the eighth or ninth aspect, the developer will not stagnate at both side ends in the developer storage portion, it is hence possible to agitate and convey the developer without displacing the developer to the lower side even if the developer storing portion is inclined in the rolling direction.

According to the technology described in the eleventh aspect, in addition to the effect obtained by any one of the eighth to tenth aspects, this configuration allows for easy attachment and detachment of the belt element and easy adjustment in assembly.

According to the technology described in the twelfth aspect, in addition to the effect obtained by the eleventh aspect, it is possible to keep the belt element constantly tensioned.

According to the image forming apparatus described in the thirteenth aspects, agitation of the developer can be done efficiently in the vertical direction and in the circulating direction of the toner agitating blades, by the toner agitating blades. Accordingly, it is possible to reduce agitation unevenness of the developer and perform prompt agitation and dispersion of the developer. This enables optimal toner supply to the developing roller, it is hence possible to realize toner images improved in image quality.

DESCRIPTION OF THE PREFERRED EMBODIMENTS

The best mode for carrying out the technology will hereinafter be described with reference to the accompanying drawings.

Figure 1:
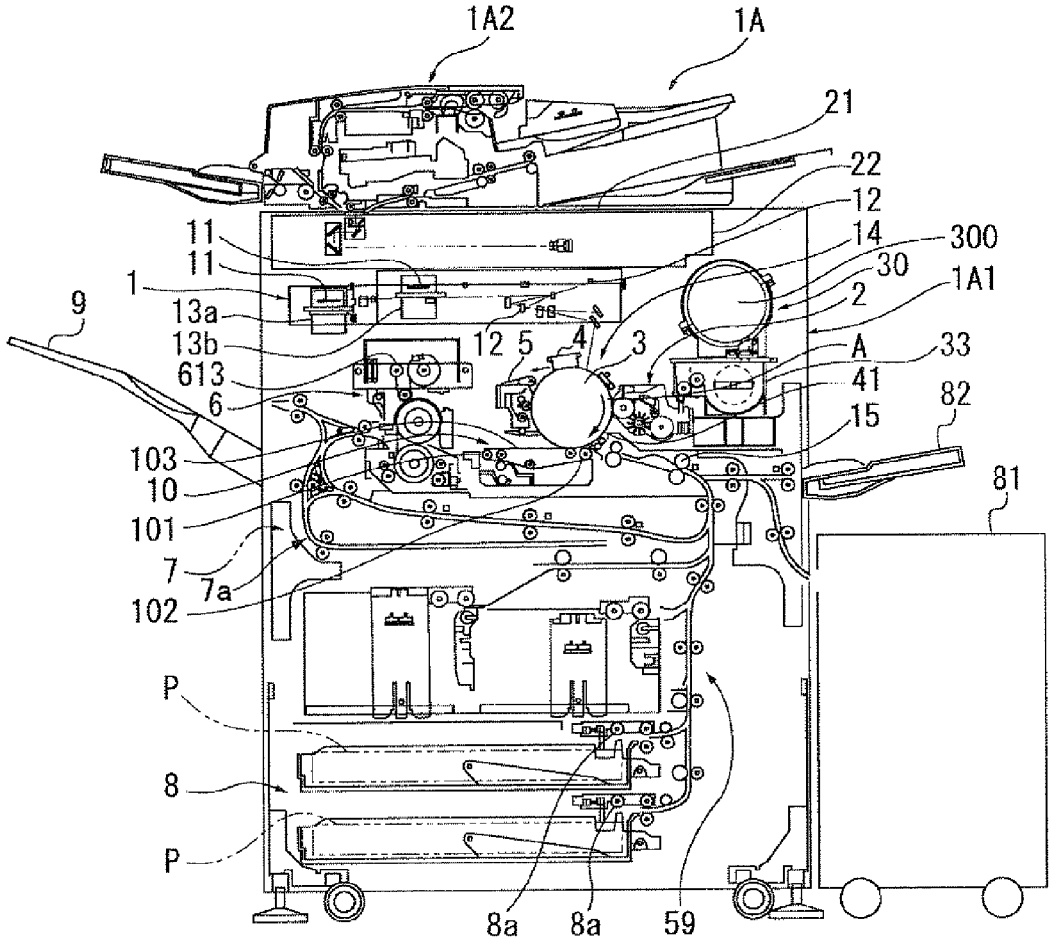
FIG. 1 is an illustrative view showing an overall configuration of an image forming apparatus.
Figure 2:
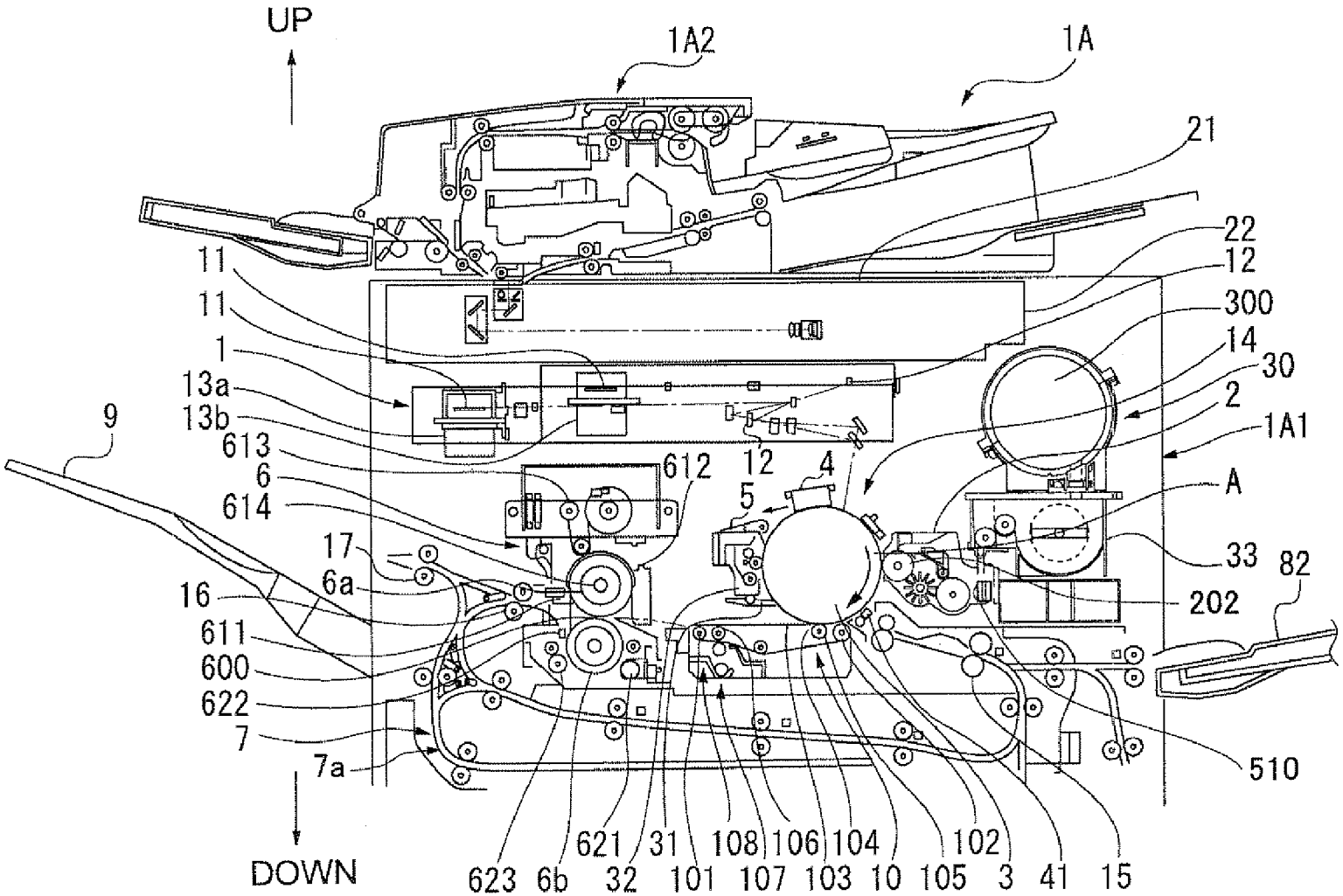
FIG. 2 is a partial detailed view showing the configuration of the apparatus body of the image forming apparatus.

FIG. 1 shows one embodiment and is an illustrative view showing an overall configuration of an image forming apparatus. FIG. 2 is a partial detailed view showing the configuration of an apparatus body of the same image forming apparatus.

Figure 3:
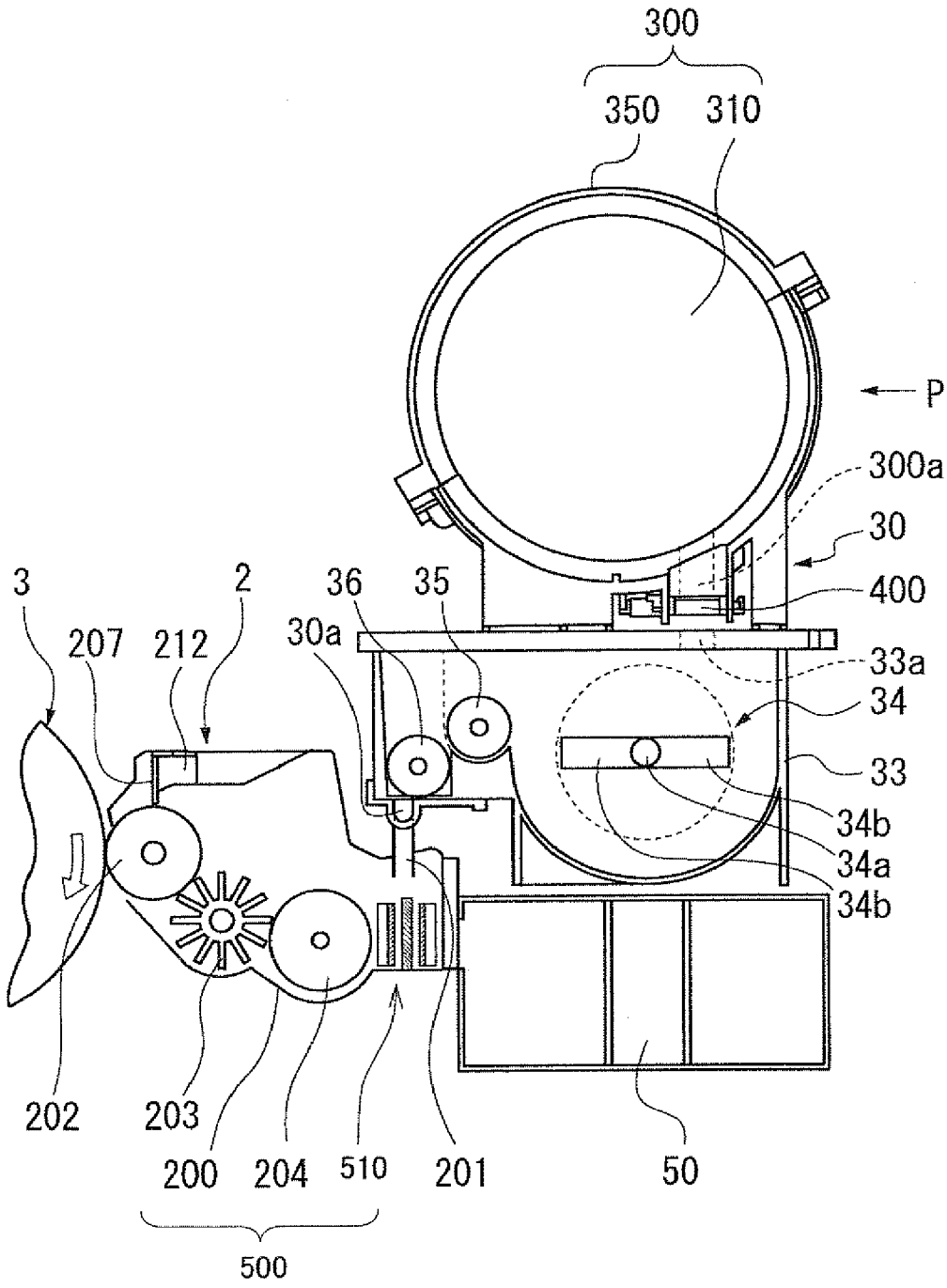
FIG. 3 is an overall side sectional view showing a developing unit and toner feed device that constitute the image forming apparatus.

As shown in FIGS. 1 and 2 an image forming apparatus 1A according to the present embodiment processes image data captured by a scanner etc., or image data transmitted from without to output a monochrome (single color) image, based on the electrophotography, by forming an electrostatic latent image on a rotationally driven, cylindrical photoreceptor drum (electrostatic latent image bearer) 3, visualizing the electrostatic latent image with an electrified developer prepared by mixing two components, or an electrostatically chargeable toner and magnetic carrier, and transferring the developed image to a predetermined sheet of recording paper (to be referred to as paper hereinbelow) as a recording medium. A developing unit 2 for visualizing the electrostatic latent image on photoreceptor drum 3 includes, as shown in FIG. 3, a hopper (developer storing portion) 200 for storing the developer that contains chargeable toner and magnetic carrier, a developing roller 202 for supplying the toner to photoreceptor drum 3 and an agitating and conveying portion 500 for agitating and conveying the developer in hopper 200.

As shown in FIG. 1, this image forming apparatus 1A includes a paper feed tray 8 which can stack multiple sheets of paper P thereon; a paper conveying portion 59 for conveying paper P fed from this paper feed tray 8 to an image forming portion 14; and a paper conveyor system 7 for conveying the paper P with an unfixed toner image printed thereon by image forming portion 14 to a fixing unit 6 where the unfixed toner is fused and fixed onto the paper. The image forming apparatus, among the conveying speeds of paper P corresponding to a multiple number of preset printout processing modes, can select and control the conveying speed of paper P in accordance with a print request and automatically feed paper P from paper feed tray 8 to a paper output tray 9.

To begin with, the overall configuration of image forming apparatus 1A will be described.

Image forming apparatus 1A is essentially composed of, as shown in FIG. 1, an apparatus body 1A1 including a light exposure unit 1, developing unit 2, a toner feed device (toner supply device) 30, photoreceptor drum 3, a charger 4, a charge erasing device 41, a cleaner unit 5, fixing unit 6, paper conveyor system 7, a paper feed path 7*a*, paper feed tray 8, paper output tray 9, a transfer device 10 and the like, and an automatic document processor 1A2.

Formed on the top surface of apparatus body 1A1 is an original placement table 21 made of transparent glass on which a document is placed. Automatic document processor 1A2 is arranged on the top of this original placement table 21 so that it can pivotally open upwards, while a scanner portion 22 as a document reader for reading image information of originals is arranged under this original placement table 21.

Arranged below scanner portion 22 are light exposure unit 1, developing unit 2, photoreceptor drum 3, charger 4, charge erasing device 41, cleaner unit 5, fixing unit 6, paper conveyor system 7, paper feed path 7*a*, paper output tray 9 and transfer device 10. Further, paper feed tray 8 that accommodates paper P therein is arranged under these.

Light exposure unit 1 provides a function of emitting laser beam in accordance with the image data output from an unillustrated image processor to irradiate the photoreceptor drum 3 surface that has been uniformly electrified by charger 4 so as to write and form an electrostatic latent image corresponding to the image data on the photoreceptor drum 3 surface. This light exposure unit 1 is arranged directly under scanner portion 22 and above photoreceptor drum 3, and includes laser scanning units (LSUs) 13*a* and 13*b* including laser emitters 11, 11 and a reflection mirror 12.

In the present embodiment, in order to achieve high-speed printing operation, multiple laser beams from multiple laser emitters 11 are used to reduce the irradiation frequency of each laser beam (the processing load of each laser beam per unit time is reduced). More specifically, a two-beam technique using a pair of laser emitters 11 to emit two laser beams is adopted.

Here, in the present embodiment laser scanning units (LSUs) 13*a* and 13*b* are used for light exposure unit 1, but an array of light emitting elements, e.g., an EL (electroluminescence) or LED (light-emitting diode) writing head may also be used.

Photoreceptor drum 3 has an approximately cylindrical shape, is arranged under light exposure unit 1 and is controlled so as to rotate in a predetermined direction (in the direction of arrow A in the drawing) by an unillustrated drive means and control means. Arranged along the peripheral surface of this photoreceptor drum 3, starting from the position at which image transfer ends downstream in the rotational direction of the photoreceptor drum are, as shown in FIG. 2, a paper separation claw 31, cleaner unit 5, charger 4 as an electric field generator, developing unit 2 and charge erasing device 41 in the order mentioned.

Paper separation claw 31 is disposed so as to be moved into and out of contact with the outer peripheral surface of photoreceptor drum 3 by means of a solenoid 32. When this paper separation claw 31 is put in abutment with the outer peripheral surface of photoreceptor drum 3, it functions to peel off the paper P that has adhered to the photoreceptor drum 3 surface during the unfixed toner image on photoreceptor drum 3 being transferred to the paper P.

Here, as a drive means for paper separation claw 31, a drive motor or the like may be used instead of solenoid 32, or any other drive means may also be selected.

Developing unit 2 visualizes the electrostatic latent image formed on photoreceptor drum 3 with black toner, and is arranged at approximately the same level at the side (on the right side in the drawing) of photoreceptor drum 3 downstream of charger 4 with respect to the rotational direction of the photoreceptor drum (in the direction of arrow A in the drawing). A registration roller 15 is disposed under this developing unit 2 on the upstream side with respect to the recording medium feed direction. This developing unit 2 will be detailed later.

Toner feed device 30 temporarily holds the toner discharged from a toner container 300 filled with toner, in an intermediate hopper 33 and then supplies it to developing unit 2. This toner feed device is arranged adjacent to developing unit 2.

Registration roller 15 is operated and controlled by an unillustrated drive means and control means so as to convey the paper P delivered from paper feed tray 8 into and between photoreceptor drum 3 and a transfer belt 103 whilst making the leading end of the paper P register with the toner image on the photoreceptor drum 3.

Charger 4 is a charging means for uniformly charging the photoreceptor drum 3 surface at a predetermined potential, and is arranged over photoreceptor drum 3 and close to the outer peripheral surface thereof.

Here, a discharge type charger 4 is used in the present embodiment, but a contact roller type or a brush type may be used instead.

Charge erasing device 41 is a pre-transfer erasing means for lowering the surface potential of the photoreceptor drum 3 in order to facilitate the toner image formed on the photoreceptor drum 3 surface to transfer to paper P, and is laid out on the downstream side of developing unit 2 with respect to the photoreceptor drum's direction of rotation and under photoreceptor drum 3 and close to the outer peripheral surface of the same.

Though in the present embodiment, charge erasing device 41 is configured using a charge erasing electrode, a charge erasing lamp or any other technique can be used instead of the charge erasing electrode.

Cleaner unit 5 removes and collects the toner left on the surface of photoreceptor drum 3 after development and image transfer, and is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper P being conveyed as transfer device 10 applies an electric field having an opposite polarity to that of the electric charge of the electrostatic image. For example, when the electrostatic image bears negative (−) charge, the applied polarity of transfer device 10 should be positive (+).

Transfer device 10 is provided as a transfer belt unit in which a transfer belt 103 having a predetermined resistivity (ranging from $1\times10^{9}$ to $1\times10^{13}\Omega\cdot$cm in the embodiment) is wound and tensioned on a drive roller 101, a driven roller 102 and other rollers, and is disposed under photoreceptor drum 3 with the transfer belt 103 surface put in contact with part of the outer peripheral surface of photoreceptor drum 3. This transfer belt 103 conveys paper P while pressing the paper against photoreceptor drum 3.

An elastic conductive roller 105 (FIG. 2) having a conductivity different from that of drive roller 101 and driven roller 102 and capable of applying a transfer electric field is laid out at a contact point 104 (FIG. 2) where transfer belt 103 comes into contact with photoreceptor drum 3.

Elastic conductive roller 105 is composed of a soft material such as elastic rubber, foamed resin etc. Since this elasticity of elastic conductive roller 105 permits photoreceptor drum 3 and transfer belt 103 to come into, not line contact, but area contact of a predetermined width (called a transfer nip) with each other, it is possible to improve the efficiency of transfer to the paper P being conveyed.

Further, a charge erasing roller 106 for erasing the electric field that has been applied to the paper P whilst being conveyed through the transfer area so as to achieve smooth conveyance of the paper to the subsequent stage is disposed on the interior side of transfer belt 103, on the downstream side, with respect to the direction of paper conveyance, of the transfer area of transfer belt 103.

As shown in FIG. 2, transfer device 10 also includes a cleaning unit 107 for removing dirt due to leftover toner on transfer belt 103 and a plurality of charge erasing devices 108 for erasing electricity on transfer belt 103. Erasure of charge by erasing devices 108 may be performed by grounding via the apparatus or by positively applying charge of a polarity opposite to that of the transfer field.

The paper P with the static image (unfixed toner) transferred thereon by transfer device 10 is conveyed to fixing unit 6, where the paper is pressed and heated so as to fuse the unfixed toner and fix it to the paper P.

Fixing unit 6 includes a heat roller 6*a* and a pressing roller 6*b* as shown in FIG. 2 and fuses and fixes the toner image transferred on paper P by rotating heat roller 6*a* so as to convey the paper P held between heat roller 6*a* and pressing roller 6*b* through the nip therebetween. Arranged on the downstream side of fixing unit 6 with respect to the direction of paper feed is a conveyance roller 16 for conveying paper P.

Arranged on the downstream side of this conveyance roller 16 with respect to the direction of paper feed is a paper discharge roller 17 for discharging paper P to paper output tray 9.

Heat roller 6*a* has a sheet separation claw 611, a thermistor 612 as a roller surface temperature detector and a roller surface cleaning member 613, all arranged on the outer periphery thereof and also includes a heat source 614 for heating the heat roller surface at a predetermined temperature (set fixing temperature: approximately 160 to 200 deg. C.) in the interior part thereof.

Pressing roller 6*b* is provided at its each end with a pressing element 621 that is capable of pressing the pressing roller 6*b* with a predetermined pressure against heat roller 6*a*. In addition a sheet separation claw 622 and a roller surface cleaning element 623 are provided on the outer periphery of pressing roller 6*b*, similarly to the outer periphery of heat roller 6*a*.

In this fixing unit 6, as shown in FIG. 2 the unfixed toner on the paper P being conveyed is heated and fused by heat roller 6*a*, at the pressed contact (so-called fixing nip portion) 600 between heat roller 6*a* and pressing roller 6*b*, so that the unfixed toner is fixed to the paper P by the anchoring effect to the paper P by the pressing force from heat roller 6*a* and pressing roller 6*b*.

As shown in FIG. 1, paper feed tray 8 stacks a plurality of sheets (paper) to which image information will be output (printed), and is arranged under image forming portion 14 made up of light exposure unit 1, developing unit 2, photoreceptor drum 3, charger 4, charge erasing device 41, cleaner unit 5, fixing unit 6 etc. A paper pickup roller 8*a* is disposed at an upper part on the paper output side of this paper feed tray 8.

This paper pickup roller 8*a* picks up paper P, sheet by sheet, from the topmost of a stack of paper stored in paper feed tray 8, and conveys the paper downstream (for convenience' sake, the paper P's starting side (the cassette side) is referred to as upstream and the paper output side is referred to as downstream) to the registration roller (also called "idle roller") 15 side in paper feed path 7*a*.

Since the image forming apparatus 1A according to the present embodiment is aimed at performing high-speed printing operations, a multiple number of paper feed trays 8 each capable of stacking 500 to 1500 sheets of standard-sized paper P are arranged under image forming portion 14. Further, a large-capacity paper feed cassette 81 capable of storing multiple kinds of paper in large volumes is arranged at the side of the apparatus while a manual feed tray 82 for essentially supporting printing etc. for irregular sized paper is arranged over the large-capacity paper feed cassette 81.

Paper output tray 9 is arranged on the opposite side across the apparatus from that of manual feed tray 82. It is also possible to configure such a system that instead of paper output tray 9, a post-processing machine for stapling, punching of output paper and the like and/or a multi-bin paper output tray etc., may be arranged as an option.

Paper conveyor system 7 is laid out between the aforementioned photoreceptor drum 3 and paper feed tray 8, and conveys paper P supplied from paper feed tray 8, sheet by sheet, by way of paper feedpath 7*a* provided for paper conveyor system 7, to transfer device 10, where a toner image is transferred from photoreceptor drum 3 to the paper, further conveying it to fixing unit 6 where the unfixed toner image is fixed to the paper, then conveys the sheet as it is being guided by paper feed paths and branch guides, in accordance with the designated paper output processing mode.

In the image forming apparatus 1A according to the present embodiment, as the predetermined output processing modes, one-sided printing mode and two-sided printing mode are prepared. In one-sided printing mode, there are two ways of paper output, i.e., the faceup output by which the paper is discharged with its printed surface faceup and the facedown output by which the paper is discharged with its printed surface facedown.

Next, developing unit 2 and its peripheral components that constitute image forming apparatus 1A according to the present embodiment will be described with reference to the drawings.

FIG. 3 is an overall side sectional view showing a developing unit and toner feed device that constitute the image forming apparatus according to the present embodiment.

In this embodiment, as shown in FIG. 3, toner feed device 30 is arranged adjacent to developing unit 2. A duct 50 for sending air to a hopper 200 that forms the exterior of developing unit 2 is provided under this toner feed device 30 in order to forcibly remove heat arising during the operation of developing unit 2.

Toner feed device 30 is arranged adjacent to developing unit 2, and temporarily reserves the toner discharged from toner container 300 filled with toner, in intermediate hopper 33 and then feeds the toner to developing unit 2. In the present embodiment, toner container 300 is configured so that a container body 310 charged with toner is rotatably supported by a supporting structure 350.

The toner sent out to intermediate hopper 33 is agitated therein by an agitator 34 first. Agitator 34 is composed of an agitator shaft 34*a* and agitating vanes 34*b* attached thereto. As agitator shaft 34*a* turns, agitating vanes 34*b* rotate about agitator shaft 34*a* to thereby agitate the toner in intermediate hopper 33 that has been fed from toner container 300.

The toner thus agitated by agitator 34 is sent by the agitating action of agitator 34 and conveyed to the feed roller 36 side via a conveying roller 35. Feed roller 36 sends out the toner that has been conveyed from agitator 34 via conveying roller 35, to an opening 30*a* that is formed at the position where intermediate hopper 33 abuts developing unit 2, to thereby supply the toner to developing unit 2.

Provided on the bottom side (the underside when toner container 300 is mounted on image forming apparatus 1A) of supporting structure 350 of toner container 300 is a shutter opening and closing mechanism 400 for opening and closing a toner feed aperture 300*a* through which toner supplied from toner container 300 is discharged out of supporting structure 350, as shown in FIG. 3. Specifically, as toner feed aperture 300*a* of supporting structure 350 is released by shutter opening and closing mechanism 400, communication between toner feed aperture 300*a* and opening 33*a* provided for intermediate hopper 33 is established, so that the toner discharged from toner container 300 is supplied to intermediate hopper 33.

Next, the characteristic configuration of developing unit 2 according to the present embodiment will be described in detail with reference to the drawings.

Figure 4:
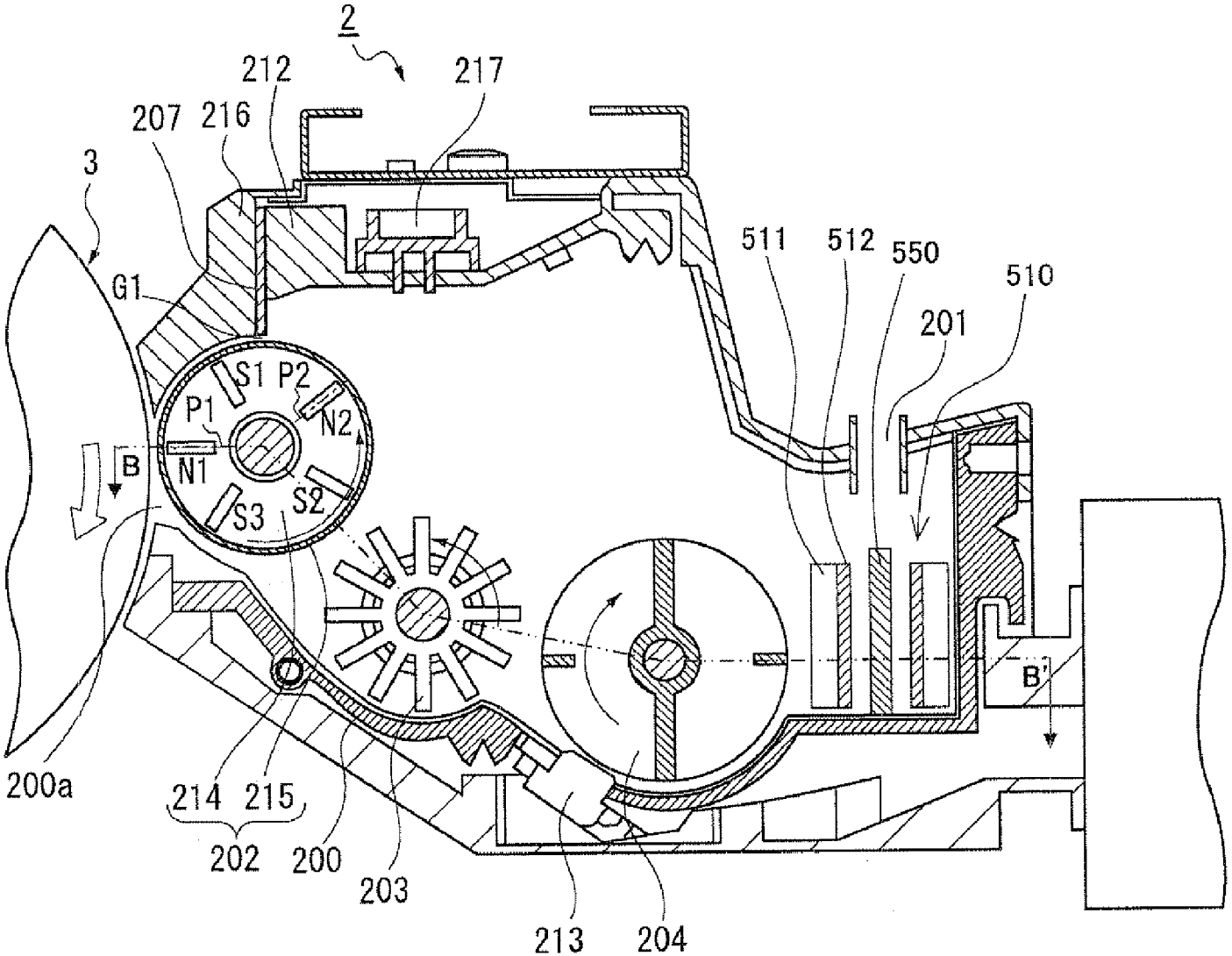
FIG. 4 is a side view showing the configuration of the developing unit.
Figure 5:
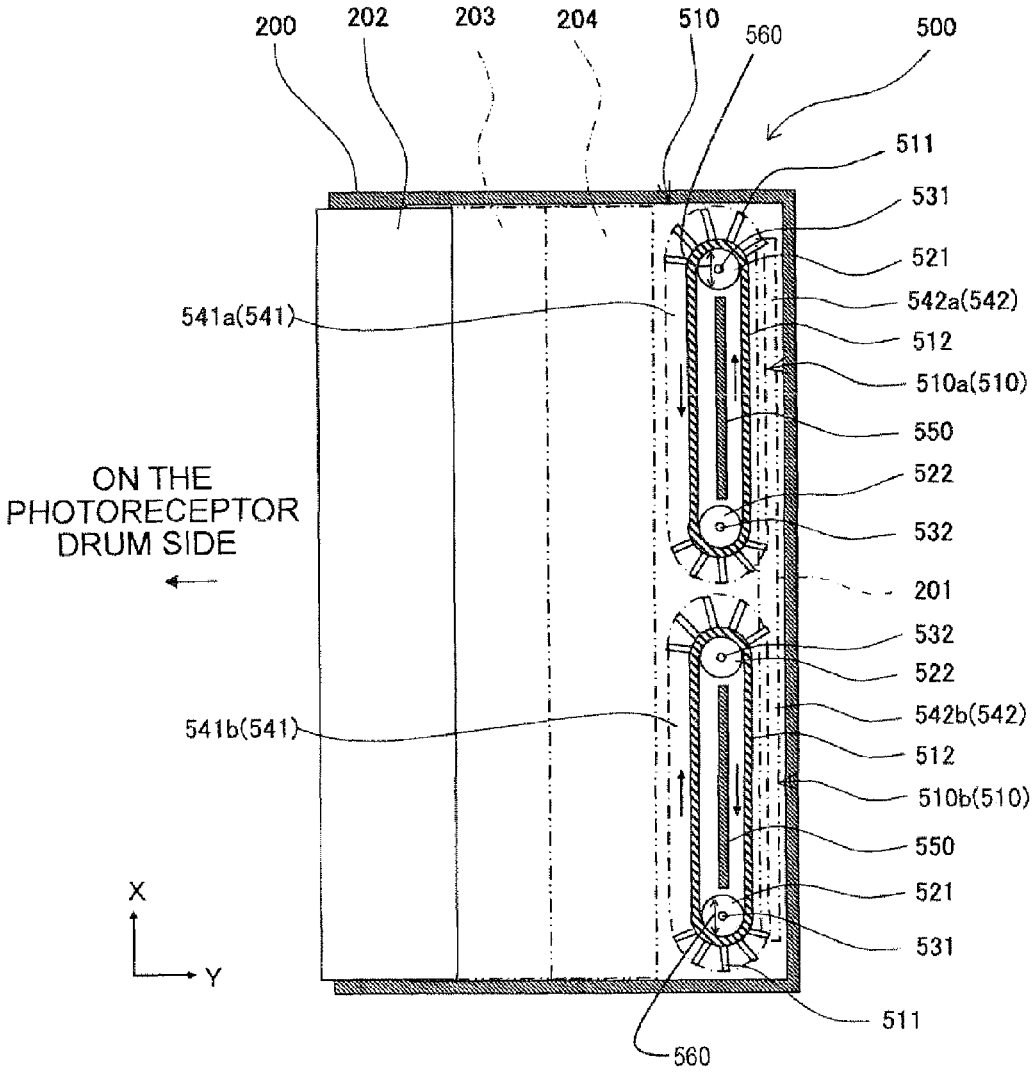
FIG. 5 is a sectional view cut along a plane B-B' in FIG. 4, showing the configuration of the developing unit.

FIG. 4 is a sectional view showing the configuration of the developing unit according to the present embodiment and FIG. 5 is a sectional view cut along a plane B-B' in FIG. 4, showing the configuration of the developing unit.

As shown in FIG. 4, developing unit 2 includes hopper (developer storing portion) 200 forming its exterior, and a toner input port 201 for leading toner is formed in this hopper 200 at a position where opening 30*a* provided for toner feed device 30 to deliver toner abuts the hopper 200. This hopper 200 reserves the developer therein and incorporates developer roller 202, a paddle roller 203, mixing roller and agitating and conveying belt (toner agitating conveyor) 510 that constitute agitating and conveying portion 500, and a regulating member 207 for limiting the amount of supplied toner.

Developing unit 2 is mounted inside image forming apparatus 1A in such a manner that the peripheral surface (the developer adhering on the peripheral area) of developing roller 202 that is partly exposed from hopper 200 opposes in proximity to the peripheral surface of photoreceptor drum 3.

In hopper 200, the toner that was fed from toner feed device 30 (FIG. 3) and input through toner input port 201 is conveyed by agitating and conveying belt 510 to mixing roller 204, where the toner is mixed with the magnetic carrier to thereby prepare the dual-component developer. Mixing roller 204 mixes the aforementioned newly formed dual-component developer with the existing developer inside hopper 200. The developer mixed by mixing roller 204 is tribo-electrified as it is agitated by paddle roller 203, then supplied to developing roller 202 for developing electrostatic latent images, and conveyed by developing roller 202 to the electrostatic latent image formed on photoreceptor drum 3. The developer (toner) supplied on developing roller 202 and conveyed thereby is controlled as to its layer thickness by regulating member 207 that is supported by a supporting member 212 as a part of hopper 200. In this way, the amount of developer (toner) to be supplied to photoreceptor drum 3 is regulated.

Hopper 200 is made of a metallic material having a high thermal conductivity such as aluminum as a countermeasure against increase in temperature inside developing unit 2, and has an approximately prism-shaped configuration having an opening 200*a* (FIG. 3) facing (opposing) the peripheral surface of photoreceptor drum 3 and also having toner input port 201 for leading toner, formed at a position in abutment with opening 30*a* provided for toner feed device 30 to deliver toner.

Provided on the upper outside part of supporting member 212 that forms the top of hopper 200 is a pressure relief mechanism 217 for releasing the pressure inside hopper 200. This pressure relief mechanism 217 is periodically operated to release the pressure inside developing unit 2 so that toner scattering inside the apparatus can be prevented.

Developing roller 202 is arranged a development gap (about 0.5 to 1.5 mm) apart from photoreceptor drum 3 as shown in FIG. 4. Developing roller 202 is formed of a magnet roller 214 with multiple magnetic poles and a non-magnetic sleeve 215 that is approximately cylindrically formed of an aluminum alloy, brass and the like and is arranged rotatably over, and relative to the magnet roller 214. In this magnetic roller 214, a plurality of bar magnets having rectangular sections, specifically magnetic pole elements N1 and N2 providing N-pole magnetic fields and magnetic pole elements S1, S2 and S3 providing S-pole magnetic fields, are radially arranged apart one from another in the order shown in FIG. 4.

Magnet roller 214 is unrotatably supported and fixed at its both ends by the side walls of hopper 200. Magnetic pole element N1 is disposed at a position opposing the peripheral surface of photoreceptor drum 3.

The chained line designated at P1 of magnetic pole element N1 represents the center of the width of the magnetic pole element N1 or the central axis of the magnetic pole, with respect to the circumferential direction of developing roller 202. Similarly, the chained line P2 of magnetic pole element N2 represents the center of the width of the magnetic pole element N2 or the central axis of the magnetic pole. These magnetic pole's center axes P1 and P2 are radially extended from the developing roller's central axis O2 and formed across the full length of the magnet elements (across the length of sleeve 215). The magnetic pole element N1 that opposes the peripheral surface of photoreceptor drum 3 is positioned so that the magnetic pole's center axis P1 substantially coincides with the line (plane) that passes through both the center axis of photoreceptor drum 3 and the center axis of developing roller 202.

The above magnetic pole elements are laid out in the order of N1, S3, S2, N2 and S1 in the rotational direction of developing roller 202. The magnetic field created by the thus arranged magnetic pole elements N1, N2, S1, S2 and S3, attracts the dual-component developer particles made of toner and carrier to the outer surface of rotating sleeve 215 so as to form brush-like spikes (to be referred as magnetic brush) extending in the circumferential direction of the sleeve. As the photoreceptor drum rotates, the photoreceptor drum 3 surface is rubbed in the above-mentioned development gap area by the magnetic brush created on rotating developing roller 202 to thereby achieve development.

Regulating member 207 controls the amount of the developer conveyed between itself and developing roller 202 while performing principal electrification of the developer, and is formed of a non-magnetic metal plate having an approximately rectangular section. One end of regulating member 207 opposes the outer peripheral surface of developing roller 202 (sleeve 215) with a gap G1 in between.

Regulating member 207 is disposed inside opening 200*a* of hopper 200 and between magnetic pole elements S1 and N2 and fixed to opening 200*a* by a cover element 216 that is attached to regulating member 207. This regulating member 207 is formed of a non-magnetic metal plate such as aluminum, stainless steel or the like.

As shown in FIGS. 4 and 5, arranged adjoining the developing roller 202 inside hopper 200 are paddle roller 203, mixing roller 204 and agitating and conveying belt (toner agitating and conveying member) 510 that provide the function as agitating and conveying portion 500 for agitating and conveying the developer to developing roller 202.

Paddle roller 203 is arranged close to and approximately parallel to the direction X of the axis of developing roller 202 (to be referred to hereinbelow as "the axial direction") and electrifies the developer that was mixed by mixing roller 204 whilst agitating it and supplies it to developing roller 202. Paddle roller 203 includes a supporting shaft extending longitudinally and a plurality of flat plate-like blades radially extending from the supporting shaft so that the blades can rotate about the supporting shaft. As paddle roller 203 rotates about the supporting shaft, the developer can be agitated.

Mixing roller 204 agitates and conveys the developer reserved in hopper 200 and is arranged adjacent to paddle roller 203 approximately parallel to the axial direction X of developing roller 202.

Agitating and conveying belt 510 conveys the toner supplied from toner feed device 30 toward mixing roller 204 whilst agitating it. Agitating and conveying belt 510 is rotatably supported adjacent to mixing roller 204 and rotationally moves along the axial direction X (FIG. 5) of mixing roller 204 (developing roller 202).

Now, agitating and conveying belt 510 which is a characteristic component of agitating and conveying portion 500 of developing unit 2 according to the present embodiment will be described in detail with reference to the drawings.

Figure 6:
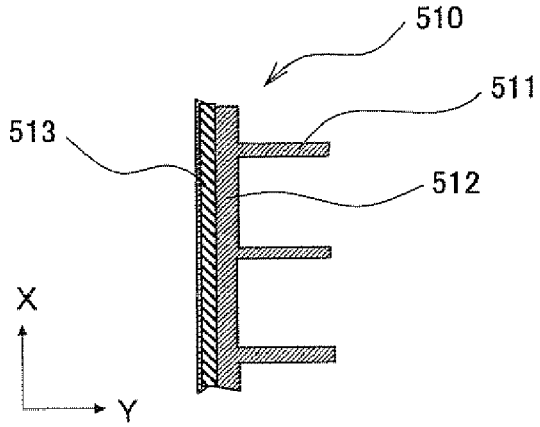
FIG. 6 is a partial detailed view showing a configuration of an agitating and conveying belt that constitutes an agitating and conveying portion of the developing unit.
Figure 7:
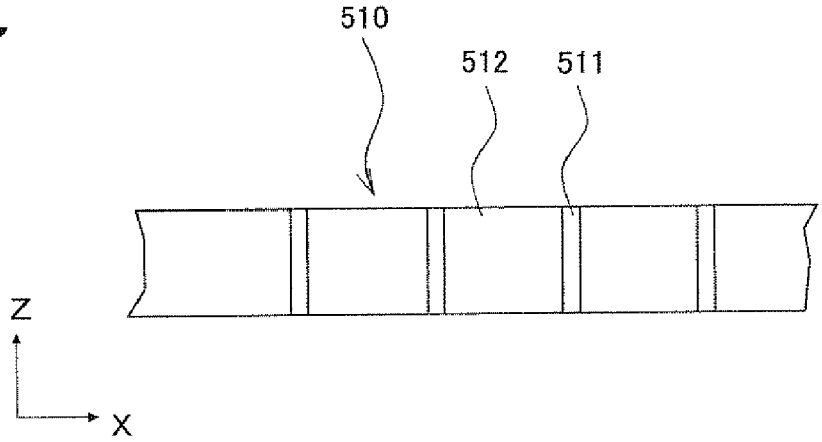
FIG. 7 is a plan view showing the configuration of the agitating and conveying belt; and, FIG. 8 is a plan view showing a variational configuration of an agitating and conveying belt according to the present embodiment.

FIG. 6 is a partial detailed view showing a configuration of an agitating and conveying belt that constitutes an agitating and conveying portion of the developing unit according to the present embodiment. FIG. 7 is a plan view showing the configuration of the agitating and conveying belt.

The characteristic configuration of agitating and conveying portion 500 that constitutes developing unit 2 of the present embodiment includes inside hopper 200, as shown in FIG. 5, an agitating and conveying belt 510 that is formed of an endless belt element, first and second pulleys 521 and 522 having the agitating and conveying belt 510 wound therebetween to circulate it thereon and first and second rotary shafts 531 and 532 for axially supporting these first and second pulleys 521 and 522, respectively.

First and second rotatory shafts 531 and 532 are arranged apart from each other with respect to the axial direction X of developing roller 202 with their axial directions oriented approximately vertically. At least one of the first and second rotary shafts is arranged so as to be movable in the axial direction X of developing roller 202 by an unillustrated adjusting mechanism.

In the present embodiment, the first rotary shaft 531 side is formed to be adjustable, so that first rotary shaft 531 is slid outward and sideward to hopper 200 to tension agitating and conveying belt 510, as illustrated by the arrows 560. With this arrangement, agitating and conveying belt 510 can be operated at around the outer side end with respect to the width direction of hopper 200, this allows for easy attachment and detachment of agitating and conveying belt 510 and easy adjustment in assembling it.

In endless agitating and conveying belt 510, a plurality of toner agitating blades 511 for agitating and conveying the developer are integrally formed on its outer belt surface. Agitating and conveying belt 510 is wound and tensioned between first and second pulleys 521 and 522 along the axial direction X of developing roller 202 so that toner agitating blades 511 move and revolve approximately horizontally with the outer peripheral surface of the belt kept substantially vertically (the outer peripheral surface of the belt kept upright or in the vertical direction Z (FIG. 7)). In the outer periphery around agitating and conveying belt 510, two toner conveying paths 541 and 542 which convey the toner in opposite directions are formed respectively on the near and far sides of developing roller 202 with the agitating and conveying belt 510 in between.

In the present embodiment, agitating and conveying belt 510 is formed of a belt base 512 having toner agitating blades 511 formed thereon and a glass fiber cloth 513 as a reinforce backing the belt base along the whole circumference as shown in FIG. 6. With this configuration, the strength of agitating and conveying belt 510 can be enhanced and its life can be increased.

As shown in FIGS. 6 and 7, each toner agitating blade 511 has a plate-like configuration and is projectively formed on the outer peripheral surface of agitating and conveying belt 510 so that the flat piece extends approximately parallel to the YZ-plane (Y: the direction perpendicular to the agitating and conveying belt 510 surface; Z: the width direction of agitating and conveying 510) or perpendicularly to the rotating direction X of the agitating and conveying belt 510.

In the interior region enclosed by agitating and conveying belt 510, a partitioning wall 550 that is formed approximately upright is extended along the axial direction X of developing roller 202 in the portion where the tensioned parts of the belt oppose each other between first and second pulleys 521 and 522, as shown in FIG. 5.

In the present embodiment, as agitating and conveying portion 500, two units of the above-described agitating and conveying belts 510, namely the first agitating and conveying belt 510*a* and the second agitating and conveying belt 510*b*, are arranged in series along the axial direction X of developing roller 202, as shown in FIG. 5.

Around first agitating and conveying belt 510*a* and second agitating and conveying belt 510*b*, first toner conveying paths 541*a* and 542*a* and second toner conveying paths 541*b* and 542*b* are formed correspondingly. In this arrangement, first agitating and conveying belt 510*a* and second agitating and conveying belt 510*b* are adapted to circulate in the opposite directions so that on the developer on the developing roller 202 side, both the developer in first toner conveying path 541*a* and the developer in second toner conveying path 541*b* move toward the approximate center with respect to the axial direction X of developing roller 202.

Next, the agitating and conveying operation of the developer by agitating and conveying belts 510 according to the present embodiment will be described.

When the toner concentration in the developer stored in hopper 200 of developing unit 2 lowers, a necessary amount of toner is supplied from toner feed device 30 into hopper 200 through the toner input port 201 (FIGS. 3 to 5) a shown in FIGS. 3 and 4. The supplied toner falls over first agitating and conveying belt 510*a* and second agitating and conveying belt 510*b* in the area on the far side from the developing roller (on the first toner conveying path 542*a* and second toner conveying path 542*b* side).

The toner supplied over first agitating and conveying belt 510*a* and second agitating and conveying belt 510*b* is conveyed and agitated with the developer having been reserved therein by toner agitating blades 511 as first agitating and conveying belt 510*a* and second agitating and conveying belt 510*b* circulate.

Specifically, the developer is agitated and conveyed in the vertical direction (in the width direction Z of agitating and conveying belt 510 (FIG. 7)) by toner agitating blades 511, so that the supplied toner is agitated and conveyed together with the developer that is agitated and conveyed upwards by toner agitating blades 511. As first agitating and conveying belt 510*a* and second agitating and conveying belt 510*b* circulate, the supplied toner and the developer are moved in the circulating directions (along the axial direction X of developing roller 202) whilst being agitated by toner agitating blades 511.

This agitating and conveying operation of the developer by toner agitating blades 511 is repeated continuously by rotating first and second agitating and conveying belts 510*a* and 510*b*, and the developer in the toner conveying paths can be agitated efficiently in the vertical direction Z.

Since first and second agitating and conveying belts 510*a* and 510*b* on the developing roller 202 side move toward the approximate center of developing roller 202 with respect to the axial direction X, the developer in first toner conveying path 541*a* and the developer in second toner conveying path 541*b* are conveyed from the both side ends to the approximate center of hopper 200.

In this way, the developer is agitated and conveyed by circulating it along the axial direction X of developing roller 202 by first and second agitating and conveying belts 510*a* and 510*b*, so that it is possible to agitate and convey the developer without causing any stagnation of the developer at both side ends of hopper 200.

According to the present embodiment thus configured, agitating and conveying belts 510 with toner agitating blades 511 are arranged in developing unit 202 along the axial direction X of developing roller 202 with their outer peripheral surfaces set approximately vertically and circulated so that toner agitating blades 511 moves approximately horizontally. Accordingly, the operation of agitating and conveying the developer in the vertical direction Z (FIG. 7) and in circulating direction X (FIGS. 5 and 7) by agitating and conveying belts 510 can be efficiently achieved, hence making it possible to reduce unevenness in agitation of the developer and enabling prompt agitation and conveyance. As a result, it is possible to achieve optimal toner supply to developing roller 202 and hence realize formation of toner images improved in image quality.

Further, according to the present embodiment, since agitating and conveying portion 500 includes paddle roller 203 and mixing roller 204 in addition to agitating and conveying belts 510, it is possible to realize a more efficient agitating and conveying operation and stably provide images of high quality.

Moreover, according to the present embodiment, as agitating and conveying portion 500, first agitating and conveying belt 510*a* and second agitating and conveying belt 510*b* both having toner agitating blades 511 are arranged in series along the axial direction X of developing roller 202, so as to convey the developer toward the approximate center with respect to the axial direction X of developing roller 202 while circulating the developer along the axial direction X of developing roller 202. Accordingly, it is possible to achieve efficient agitation and conveyance of the developer without causing any stagnation of the developer at both side ends of hopper 200 with respect to the axial direction X of developing roller 202.

Here in the present embodiment, though agitating and conveying belt 510 is constructed so that toner agitating blades 511 are positioned approximately perpendicularly (parallel to the YZ-plane) to the circulating direction X of agitating and conveying belt 510, the configuration of agitating and conveying blades 511 should not be limited to this.

Figure 8:
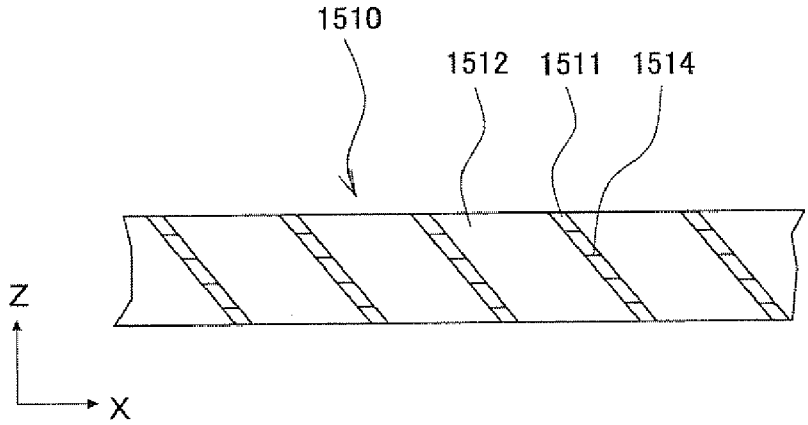

For example, as a variation, an agitating and conveying belt 1510 as shown in FIG. 8 may be constructed so that toner agitating blades 1511 are provided on a belt base 1512, being inclined to the downstream side of circulating direction X of agitating and conveying belt 1510 relative to the YZ-plane (Y: the direction perpendicular to the agitating and conveying belt 1510 surface; Z: the width direction of agitating and conveying 1510). Here, as the above inclined configuration, toner agitating blades 1511 may be inclined with either their top or bottom shifted to the downstream side. Shown in FIG. 8 is an example in which toner agitating blades 1511 are inclined with their top shifted to the downstream side.

Further, in each of toner agitating blades 1511 in FIG. 8 a plurality of cutouts 1514 that extend in the circulating direction X of agitating and conveying belt 1510 are formed from the top of the blade 1511 to belt base 1512 where the blade 1511 is attached. That is, each toner agitating blade 1511 is formed so that a plurality of agitating pieces are arranged in a row across the width Z of agitating and conveying belt 1510.

Since cutouts 1514 are formed in each toner agitating blade 1511, these cutouts 1514 permits toner agitating blade 1511 to break up into pieces when toner agitating blade 1511 deforms as agitating and conveying belt 1510 advances over the pulleys. As a result it is possible to reduce the stress arising in agitating and conveying belt 1510 owing to deformation of toner agitating blades 1511, hence inhibit degradation of the performance of agitating and conveying belt 1510.

Also, though in the present embodiment, as the rotary shafts for supporting the circulating agitating and conveying belt 510, first rotary shaft 531 is displaceable so as to tension the belt by shifting first rotary shaft 531 outward in the width direction of hopper 200, the rotary shaft configuration should not be limited to this. For example, at least one rotary shaft of first and second rotary shafts in the present embodiment may be kept urged in a direction that gives tension to agitating and conveying belt 510.

With this configuration, it is possible to set agitating and conveying belt 510 constantly tensioned, hence provide a maintenance-free configuration.

Further, though in the present embodiment, agitating and conveying belt 510 is used as the toner agitating and conveying member for the developer agitating and conveying portion, the agitating and conveying member should not be limited to agitating and conveying belt 510. For example, it is possible to provide a configuration in which a rotator having toner agitating blades formed on the outer periphery is adopted instead of a belt element such as agitating and conveying belt 510. It is also possible to develop a configuration in which a multiple number of the aforementioned rotators are arranged parallel to each other. With this configuration, it is possible to expect the developer to be agitated and conveyed continuously and efficiently, similarly to the aforementioned belt element.

Having described preferred embodiments, the technology should not be limited to the above-described examples, and it is obvious that various changes and modifications will occur to those skilled in the art within the scope of the appended claims. Such variations are therefore understood to be within the technical scope of the technology.

For example, in the above-described embodiment, the technology is applied to an image forming apparatus including a monochrome developing unit, but it can be also be applied to a color image forming apparatus including a plurality of developing units.

What is claimed is:

1. A developing unit for visualizing an electrostatic latent image formed on an electrostatic latent image bearer with a toner, comprising:

a developer storing portion for storing a developer containing an electrostatically chargeable toner and a magnetic carrier;

a developing roller for supplying the toner to an electrostatic latent image bearer on which an electrostatic latent image is formed; and an agitating and conveying portion for agitating and conveying the developer in the developer storing portion, the agitating and conveying portion comprising first and second toner agitating and conveying members that are arranged in series in the axial direction of the developing roller, wherein each toner agitating and conveying member comprises an endless belt with toner agitating blades, the endless belts being rotatably arranged in the developer storing portion with their rotational axes oriented approximately vertically so as to rotate the toner agitating blades approximately horizontally, and wherein the endless belts of the first and second agitating and conveying members are rotated in opposite directions such that they convey toner on the developing roller side of the belts from sides of the developer storing portion toward a central portion of the developer storing portion.

2. The developing unit according to claim 1, wherein a toner supply device for supplying toner when the toner concentration in the developer inside the developer storing portion has lowered is arranged at the top of the developer storing portion, and the toner agitating and conveying members are arranged under the toner supply device, and wherein the toner agitating and conveying members agitate and convey the toner supplied from the toner supply device.

3. The developing unit according to claim 1, wherein the toner agitating blades are located on the outer periphery of the endless belts.

4. The developing unit according to claim 3, wherein the endless belts are backed by a reinforcing layer that is attached to a belt base upon which the agitating blades are provided.

5. The developing unit according to claim 1, wherein the toner agitating blades extend approximately perpendicularly relative to the circulating direction of the endless belts.

6. The developing unit according to claim 1, wherein the toner agitating blades are inclined with respect to the circulating direction of the endless belts such that a bottom edge of each blade at the bottom of the belt is located further forward in the circulating direction than a top edge of the blade at the top of the belt.

7. The developing unit according to claim 6, wherein in each of the toner agitating blades a plurality of cutouts are formed along the width direction of the belt, from the top of the toner agitating blade toward the base of the endless belt where the toner agitating blade is attached.

8. The developing unit according to claim 3, wherein each of first and second agitating and conveying members also includes:

first and second rotary shafts provided inside the developer storing portion and arranged apart from each other in the axial direction of the developing roller; and first and second pulleys which are axially supported by the first and second rotary shafts respectively, wherein one of the endless belts is wound between first and second pulleys and supported along the axial direction of the developing roller, and wherein a toner conveying path through which the toner is conveyed is formed along and around each belt in the developer storing portion, the toner on the near side of the developing roller and the toner on the far side thereof with the belt being conveyed in opposite directions to each other.

9. The developing unit according to claim 8, wherein a partitioning wall that extends in the axial direction of the developing roller is arranged in the inside area enclosed by each of the endless belts and between the first and second pulleys around which the belt is wound.

10. The developing unit according to claim 8, wherein at least one rotary shaft of the first and second rotary shafts of each of the agitating and conveying members is arranged so as to be shiftable in the axial direction of the developing roller.

11. The developing unit according to claim 10, wherein at least one rotary shaft of the first and second rotary shafts is urged in a direction that gives tension to the belt element.

12. An image forming apparatus comprising:

an electrostatic latent image bearer on which an electrostatic latent image is formed;

a developer storing portion for storing a developer containing an electrostatically chargeable toner and a magnetic carrier;

a developing roller for supplying the toner to the electrostatic latent image bearer; and an agitating and conveying portion for agitating and conveying the developer in the developer storing portion, whereby printout of an image is formed by transferring a developer image formed by electrophotography on the surface of the electrostatic latent image bearer, to a transfer medium, the agitating and conveying portion comprising first and second toner agitating and conveying members that are arranged in series in the axial direction of the developing roller, wherein each toner agitating and conveying member comprises an endless belt with toner agitating blades, the endless belts being rotatably arranged in the developer storing portion with their rotational axes oriented approximately vertically so as to rotate the toner agitating blades approximately horizontally, and wherein the endless belts of the first and second agitating and conveying members are rotated in opposite directions such that they convey toner on the developing roller side of the belts from locations at sides of the developer storing portion toward a central portion of the developer storing portion.

13. The image forming apparatus unit according to claim 12, wherein a toner supply device for supplying toner when the toner concentration in the developer inside the developer storing portion has lowered is arranged at the top of the developer storing portion, and the toner agitating and conveying members are arranged under the toner supply device, and wherein the toner agitating and conveying members agitate and convey the toner supplied from the toner supply device.

14. The image forming apparatus unit according to claim 12, wherein the toner agitating blades are located on the outer periphery of the endless belts.

15. The image forming apparatus unit according to claim 14, wherein the endless belts are backed by a reinforcing layer that is attached to a belt base upon which the agitating blades are provided.

16. The image forming apparatus unit according to claim 12, wherein the toner agitating blades extend approximately perpendicularly relative to the circulating direction of the endless belts.

17. The image forming apparatus unit according to claim 12, wherein the toner agitating blades are provided-inclined with respect to the circulating direction of the endless belts such that a bottom edge of each blade at the bottom of the belt is located further forward in the circulating direction that a top edge of the blade at the top of the belt.

18. The image forming apparatus unit according to claim 17, wherein in each of the toner agitating blades a plurality of cutouts are formed along the width direction of the belt element, from the top of the toner agitating blade toward a base of the endless belt where the toner agitating blade is attached.

19. The image forming apparatus unit according to claim 14, wherein each of the first and second agitating and conveying members also includes:

first and second rotary shafts provided inside the developer storing portion and arranged apart from each other in the axial direction of the developing roller; and first and second pulleys which are axially supported by the first and second rotary shafts respectively, wherein one of the endless belts is wound between first and second pulleys and supported along the axial direction of the developing roller, and wherein a toner conveying path through which the toner is conveyed is formed along and around the belt element in the developer storing portion, the toner on the near side of the developing roller and the toner on the far side thereof with the belt being conveyed in opposite directions to each other.

20. The image forming apparatus unit according to claim 19, wherein a partitioning wall that extends in the axial direction of the developing roller is arranged in the inside area enclosed by each of the endless belts and between the first and second pulleys.

21. The image forming apparatus unit according to claim 19, wherein at least one rotary shaft of the first and second rotary shafts of each of the agitating and conveying member is arranged so as to be shiftable in the axial direction of the developing roller.

22. The image forming apparatus unit according to claim 21, wherein at least one rotary shaft of the first and second rotary shafts is urged in a direction that gives tension to the belt element.

* * * * *